US007806290B2

(12) United States Patent
Timm et al.

(10) Patent No.: US 7,806,290 B2
(45) Date of Patent: Oct. 5, 2010

(54) RELEASE SYSTEM FOR CONTAINER

(75) Inventors: Allen G. Timm, Hartford, WI (US); Joachim Banik, Oconomowoc, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 1812 days.

(21) Appl. No.: 10/874,818

(22) Filed: Jun. 22, 2004

(65) Prior Publication Data

US 2005/0279753 A1 Dec. 22, 2005

(51) Int. Cl.
*B65D 43/16* (2006.01)

(52) U.S. Cl. ..... 220/835; 220/324; 220/263

(58) Field of Classification Search ..... 220/262, 220/263, 324, 835, 521; 215/235, 237
See application file for complete search history.

(56) References Cited

U.S. PATENT DOCUMENTS

| | | | | |
|---|---|---|---|---|
| 1,501,798 | A | 7/1924 | Morrison | |
| 3,578,203 | A * | 5/1971 | Mainet | 220/787 |
| 3,581,926 | A * | 6/1971 | Roder | 215/330 |
| 4,369,799 | A * | 1/1983 | Napoleon | 132/294 |
| 4,454,889 | A | 6/1984 | Contreras, Sr. | |
| 4,863,034 | A * | 9/1989 | Contreras, Sr. | 206/581 |
| 4,917,131 | A | 4/1990 | Contreras, Sr. | |
| 5,050,623 | A | 9/1991 | Yuhara et al. | |
| 5,323,902 | A * | 6/1994 | Palmer et al. | 206/366 |
| 5,358,151 | A * | 10/1994 | Strasenburgh | 222/420 |
| 5,400,912 | A * | 3/1995 | Brown et al. | 215/238 |
| 5,435,456 | A * | 7/1995 | Dubach | 220/838 |
| 5,505,299 | A | 4/1996 | Ditzig et al. | |
| 5,547,091 | A * | 8/1996 | Neveras et al. | 215/237 |
| 5,842,486 | A | 12/1998 | Davis et al. | |
| 5,875,942 | A * | 3/1999 | Ohmi et al. | 222/556 |
| 6,129,089 | A * | 10/2000 | Yuhara | 132/300 |
| 6,138,686 | A | 10/2000 | Yuhara | |
| 6,199,559 | B1 | 3/2001 | Nikolaus et al. | |
| 6,283,129 | B1 | 9/2001 | Yuhara et al. | |
| 6,460,712 | B2 * | 10/2002 | Smith et al. | 215/235 |
| 6,510,971 | B1 * | 1/2003 | Martin | 222/556 |
| 2004/0188454 | A1 * | 9/2004 | Tayebi | 220/839 |
| 2004/0217139 | A1 * | 11/2004 | Roth et al. | 224/148.7 |

FOREIGN PATENT DOCUMENTS

JP 08191714 A * 7/1996

OTHER PUBLICATIONS

Push-button release of a type understood to be commercially available and having a deck that is slid under an overhanging element to hide the spring element. (two photographs, one sheet).

(Continued)

*Primary Examiner*—Anthony Stashick
*Assistant Examiner*—James N Smalley
(74) *Attorney, Agent, or Firm*—Chad D. Bruggeman; John F. Salazar; Middleton Reutlinger

(57) ABSTRACT

A release system for releasably securing a container in a closed position is provided. The release system is integrally molded with a container component that is to be applied to a container. The release system is integrally formed with the container component in a first position that may be rotatably moved to a second position.

29 Claims, 7 Drawing Sheets

OTHER PUBLICATIONS

Push-button release of a type understood to be commercially available and having a push-button that is a separate element. (two photographs, one sheet).

Push-button release of a type understood to be commercially available and having a visible spring element. (two photographs, one sheet).

* cited by examiner

RELEASE SYSTEM FOR CONTAINER

FIELD

The present invention relates generally to a container or case for holding an article such as cosmetics. More particularly, the present invention relates to a release system capable of releasably securing a container or case in a closed position. The present invention further relates to a release system that is integrally molded with a component of the container in a first position and is moved relative the component into a second position.

BACKGROUND

It is generally known to provide a container or case for holding makeup or cosmetics, such as, powders, eye shadow, eyeliner, lipstick, or other beauty aids. Typically, the container includes a bottom portion for retaining the cosmetic substance and a top portion for retaining the mirror. It is common for the top portion to be pivotally coupled to the bottom portion by a hinge member. Either the top portion or the bottom portion may be pivoted about the hinge to obtain a closed position, thereby providing a convenient storage device. Generally, the top portion and the bottom portion are fastened together in a closed position by a latch that is released by the actuation of a release system.

A generally known release system is the push-button. A user actuates the push-button by applying a force to the push-button which causes the push-button to move in a linear direction. The linear movement of the push-button disengages the latch used to releasably secure the container in the closed position. Push-button release systems are typically positioned along a front edge of the container and are used to latch the top portion of the cosmetic compact to the bottom portion.

It is generally known to provide a push-button release system that uses separate components to provide a push-button release system for a container. A problem with such known release systems is that there is generally an increased cost with such a configuration since the push-button is a separate component requiring it to be made or purchased separate from the rest of the container components. In addition, trying to assemble a push-button that is a separate component is difficult to automate.

Other known containers having push-button like release systems include configurations wherein the release systems are integrally formed with a deck portion of the container. Such configurations often require an undesirable visible gap in an exposed portion of the container system to enable the push-button operate and/or may be difficult to automate because the release system cannot be installed into a container with a single motion.

Thus there is a need for an improved container system having a push-button release system that is inexpensive, simple to assemble, and able to reduce undesirable gaps in the exposed inner surface of the container system. To provide such a container system, it would be advantageous to provide a container component having an integrally formed release system, wherein the release system is formed in one position and then moved to a second position when applied to the container.

It would be desirable to provide a container system having any one or more of these or other advantageous features.

SUMMARY

A package configured to be applied to a container for retaining an article, such as a cosmetic substance is provided. The package includes a container component integrally formed with a release system. The release system includes a user interface and a linking member. The release system is formed in a first position and configured to be rotated to a second position. Preferably, the release system is integrally formed with the container component in a position approximately 90 degrees rotated from the second position.

Also provided is a container system for retaining a cosmetic article. The container system includes a container having a top portion and a bottom portion, and a package having a container component integrally formed with a release system. The release system is formed in a first position and configured to be rotated to a second position. The release system includes a user interface and a linking member.

Further provided is a method of manufacturing a package configured for use with a container system. The method includes the steps of forming a container component and a release system having a user interface and a linking member as an integrally formed unitary body. The method further includes the step of forming the release system in a first position. In the first position, the release system is rotatably displaced from a second position.

Further provided is a method of providing a container system configured to retain a cosmetic article. The method includes the steps of forming a container component and a release system having a user interface and a linking member as an integrally formed unitary body, and forming the release system in a first position. In the first position, the release system is rotatably displaced from a second position. The method further includes the steps of rotating the release system into the second position; and applying the container component and the release system to a bottom portion of a container.

A further understanding of the nature and advantages of the push-button release system disclosed herein may be realized by reference to the remaining portions of the specification and the drawings. It is to be understood that the invention is not limited in its application to the details of construction and the arrangements of components set forth in the following description or illustrated in the drawings.

DETAILED DESCRIPTION

Before proceeding to a description of the of the preferred and other exemplary embodiments, several general comments may be made about the applicability and the scope thereof.

First, one particular embodiment of the release system is shown in the FIGURES, namely one having a user interface and a linking member, with each being integrally formed with a first platform. In addition, one particular application for the release system is shown, namely a generally rectangular container configured to retain a cosmetic substance. It should be understood at the outset that the present invention has broad applicability to container systems for cosmetic substances, cosmetic applicators, dry and wet tissues, and any other container system where a release system integrally formed with a component of the container (e.g., a first platform) may be used to reduce manufacturing costs and improve the aesthetic appearance of the container system.

It should further be understood that the present invention is not intended to be limited to the preferred embodiment of the release system illustrated in the FIGURES. For example, alternative embodiments may alter the shape, size, orientation, and placement of the user interface, the linking member, and the container component.

Proceeding now to a description of the preferred and other exemplary embodiments, the FIGURES illustrate a release system 10 configured for use with a cosmetic compact (e.g., makeup case) or container 70 for holding a cosmetic substance, such as, foundation, lip gloss, powder, eye shadow, eyeliner, or any other cosmetic substance. As mentioned above, release system 10 is not limited to containers configured to hold cosmetics and may be equally suitable for use with a variety of other container systems.

Figure 7:
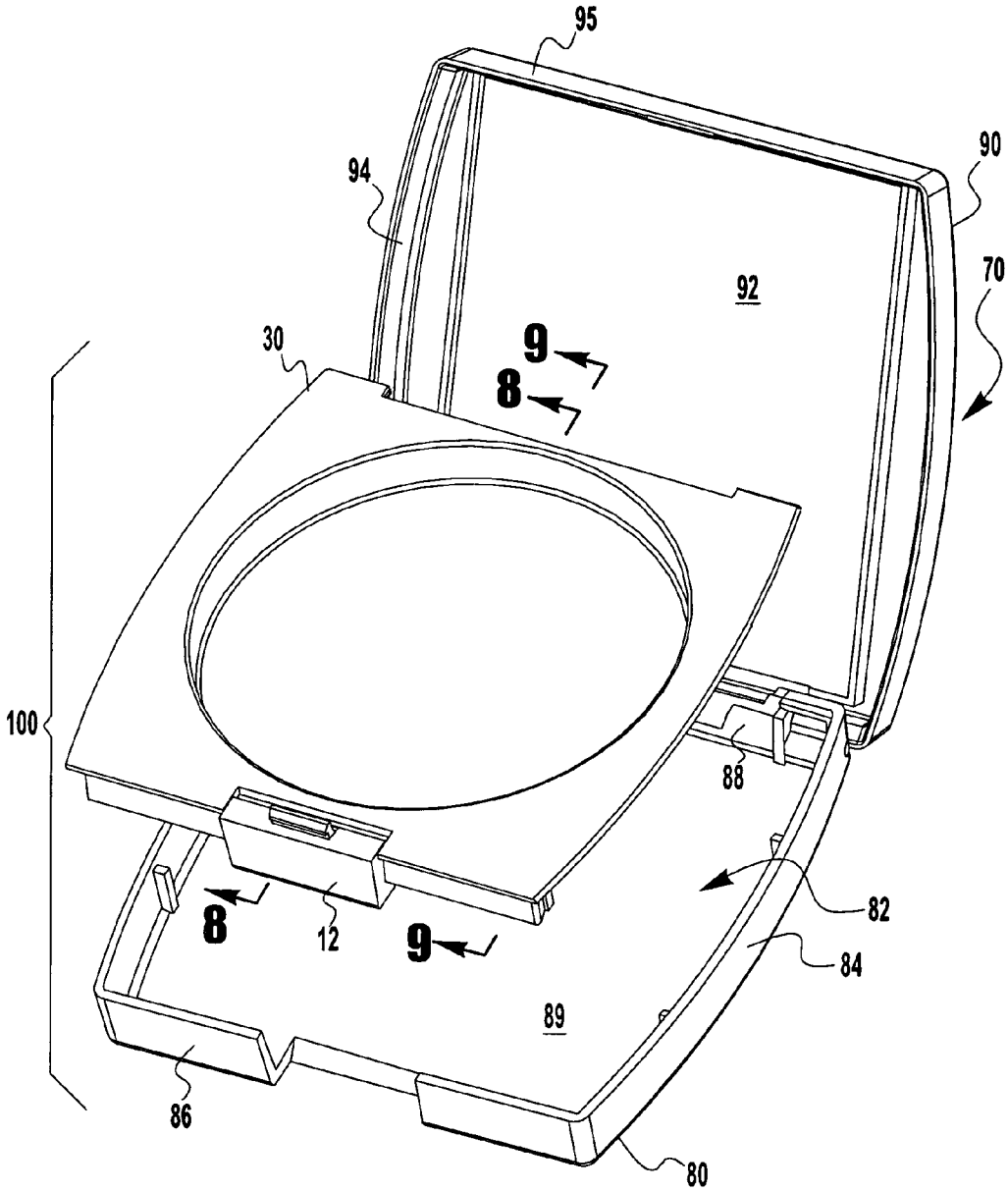
FIG. 7 is a perspective exploded view of a container system in accordance with an exemplary embodiment, the container system includes a release system that is illustrated in a second position.

Release system 10 generally includes a user interface 12 and a linking member 16. The user interface 12 and the linking member 16 are integrally formed with a container component (e.g., deck, liner, receptacle, insert, etc.) that is to be coupled to the container 70. The integral combination of the release system 10 and a container component is referred to herein as a "package." In various alternative embodiments, the package may constitute a lower or upper portion of a container or may simply be coupled to a lower or upper portion of a container. Release system 10 is formed in a first position (e.g., molded position, etc.) (shown in FIG. 3) and moved to a second position (e.g., use position, etc.) (shown in FIG. 7) before or as the package is coupled to the container 70. Providing a release system 10 that is integrally formed with a component of the container advantageously reduces the increased costs commonly associated with container systems having a release mechanism configured as a separate mechanism. Further, providing a release system that is configured to be formed in a first position and is later moved to a second position either before, or as, the package is being coupled to a container advantageously allows for improved aesthetic appearance over conventionally known release systems.

According to a preferred embodiment, release system 10 is a push-button type release system. The language "push-button type release system" is used herein to describe a release system wherein a user actuates the release system by depressing a user interface. Depression of the user interface may allow a top portion, or other portion, of a container to move from a closed storage position to an open use position. In alternative embodiments, release system 10 may be configured as a type of release system other than a push-button type release system.

Figure 3:
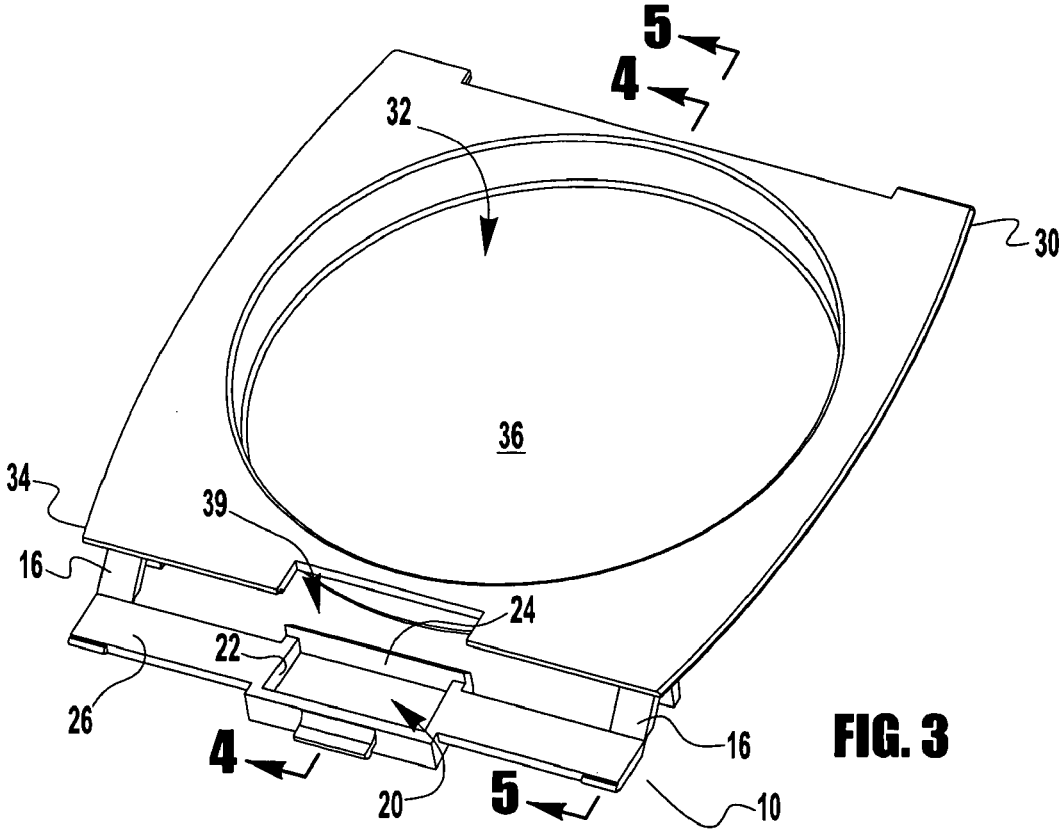
FIG. 3 is a perspective view of a package for use with a container in accordance with an exemplary embodiment, the package is shown as having a release system and a first platform.

Referring to FIG. 3, release system 10 is shown in a first position and integrally formed with a deck, or first platform 30. First platform 30 is a container component that is configured to be applied to a bottom portion of a container. The integral combination of release system 10 and first platform 30 is referred herein as a "package." As mentioned above, the term "package" may also be used to described a release system that is integrally formed with a container component other than first platform 30.

According to a preferred embodiment, first platform 30 includes a cavity 32 for retaining an article such as a cosmetic substance (e.g., powder, lip gloss, eye shadow, etc.), a cosmetic applicator (e.g., brushes, pens, pencils, etc.), dry or wet tissues, etc. In alternative embodiments, first platform 30 may include a plurality of cavities for retaining a combination of articles. According to another alternative embodiment, first platform 30 may not include a cavity 32, and instead may be configured as a substantially flat surface or as having a projection having a receptacle for supporting an article.

First platform 30, together with release system 10, is formed through a molding operation and may be made of a relatively flexible material. Providing a material that is relatively flexible allows for the release system 10 to move from a first position to a used second position. Injection molded acrylonitrile butadiene styrene ("ABS") is the preferred method and material for making the package, but other materials can be used, including other thermoplastic resins such as, polypropylene, polyurethane nylon, any of a variety of homopolymer plastics, copolymer plastics, plastics with special additives, filled plastics, etc. Also, other molding operations may be used to form the first platform 30 and the release system 10, such as compression molding and any other appropriate molding operation.

Figure 4:
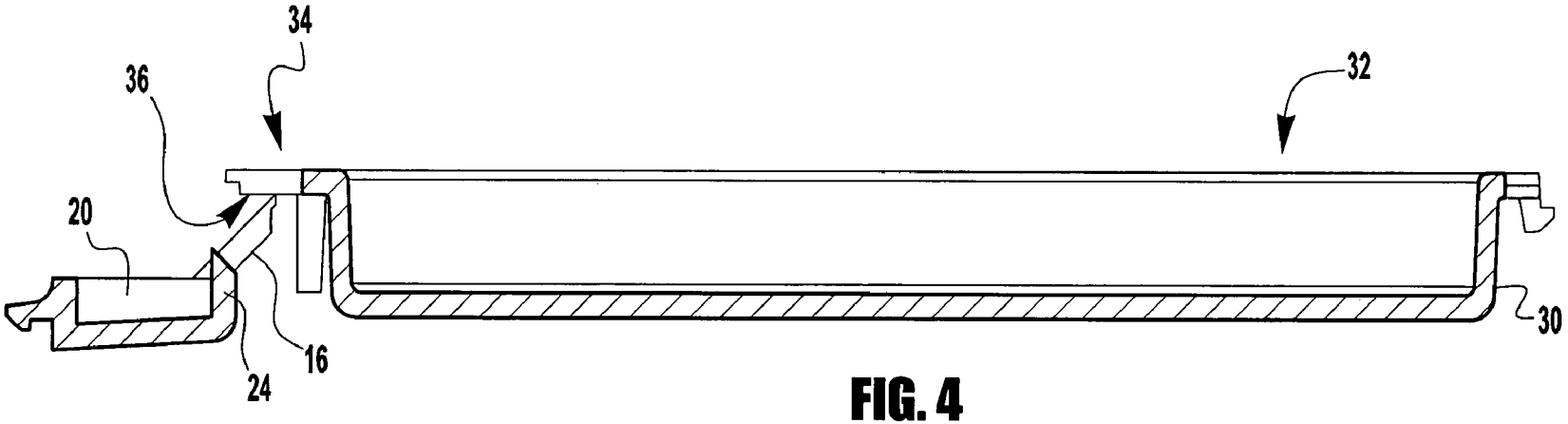
FIG. 4 is a cross sectional view of a package along line 4-4 of FIG. 3 in accordance with an exemplary embodiment.
Figure 5:
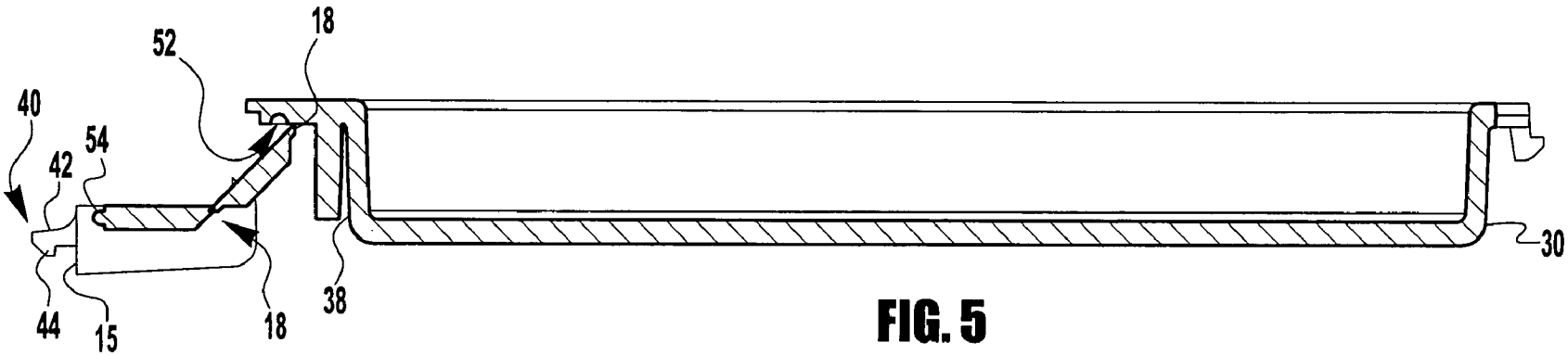
FIG. 5 is a cross sectional view of a package along line 5-5 of FIG. 3 in accordance with an exemplary embodiment.

As shown by FIGS. 4 and 5, release system 10 is preferably positioned near a front portion 34 of the first platform 30. First platform 30 may include a missing or cutout portion 39 for receiving a portion of the release system when rotated into the second position (shown in FIG. 3). First platform 30 may further include a surface that is intended to shield or cover a portion of the release system when the release system is rotated into the second position, thereby allowing undesirable apertures or gaps to be hidden. In alternative embodiments, release system 10 may be positioned anywhere along the first platform 30, such as along a side of the first platform or along a rear portion. Further, in alternative embodiments, it may be desirable to provide more than one release system for releasably securing a container in a closed position.

As mentioned above, release system 10 generally includes a user interface, and a linking member. According to a preferred embodiment, release system 10 includes two linking members 16 one positioned near each opposing end of front portion 34 of first platform 30. Preferably linking members 16 are not coupled to a surface of first platform 30 that is exposed to a user when the package is applied to the container 70, but are instead coupled to an unexposed surface such as a bottom surface 36 or a side wall 38 of first platform 30. Coupling linking members 16 to an unexposed surface is intended to hide undesirable lines from the view of a user when the package is applied to the container 70.

According to an embodiment, linking members 16 are pivotally coupled to first platform 30 and configured to pivot between the first position and second position. Linking members 16 may be pivotally coupled to first platform 30 by a pair of living hinges 18. Living hinges 18 are flexible members providing for the rotation of linking members 16 from the first position to the second position. Living hinges 18 may be integrally formed with linking members 16 and first platform 30.

Figure 2:
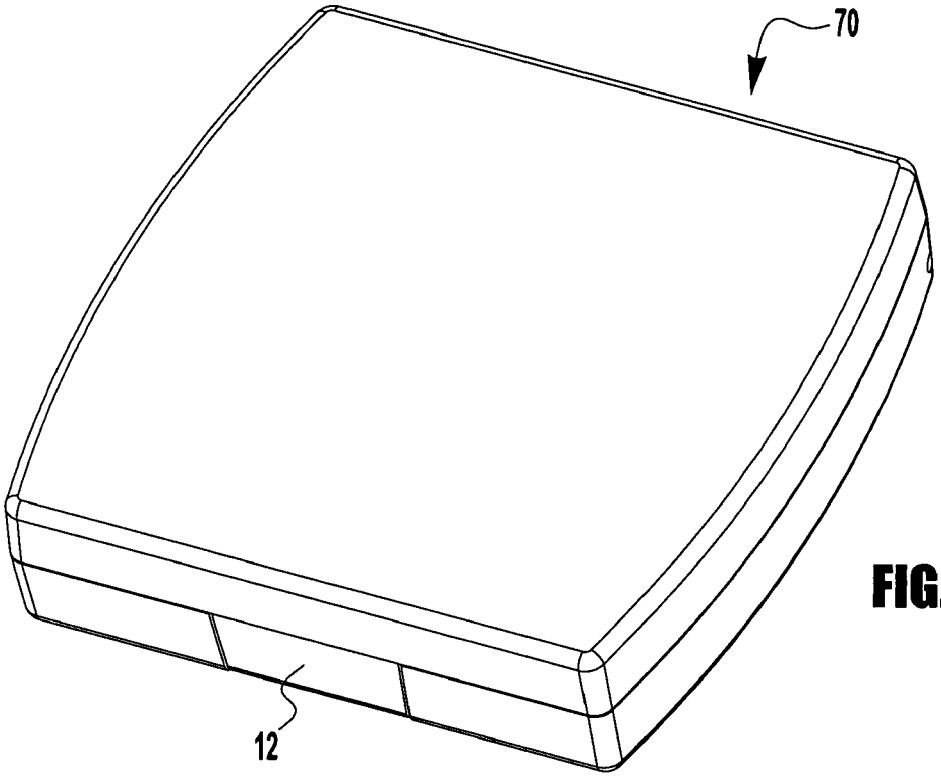
FIG. 2 is a perspective view of container system in accordance with an exemplary embodiment, the container system is shown in a closed position.

Release system 10 further includes the user interface 12 to actuate the release system and thereby enable the container 70 to be moved to an open use position. According to a preferred embodiment, user interface 12 is a push-button configured to actuate the release system upon being depressed by a user. In the second position, user interface is designed to move in a substantially linear direction when a user applies a sufficient force to the user interface. Referring to FIGS. 2 and 3, user interface 12 is illustrated as a generally rectangular member. According to one embodiment, the user interface may include a back side having an aperture 20 defined by sidewalls 22 and a bottom sidewall 24. As can be appreciated, user interface 12 may be configured in a variety of shapes and sizes. For example, user interface 12 may be a relatively solid member or may be configured as a member having a cutout portion.

Figures 6, 6A:
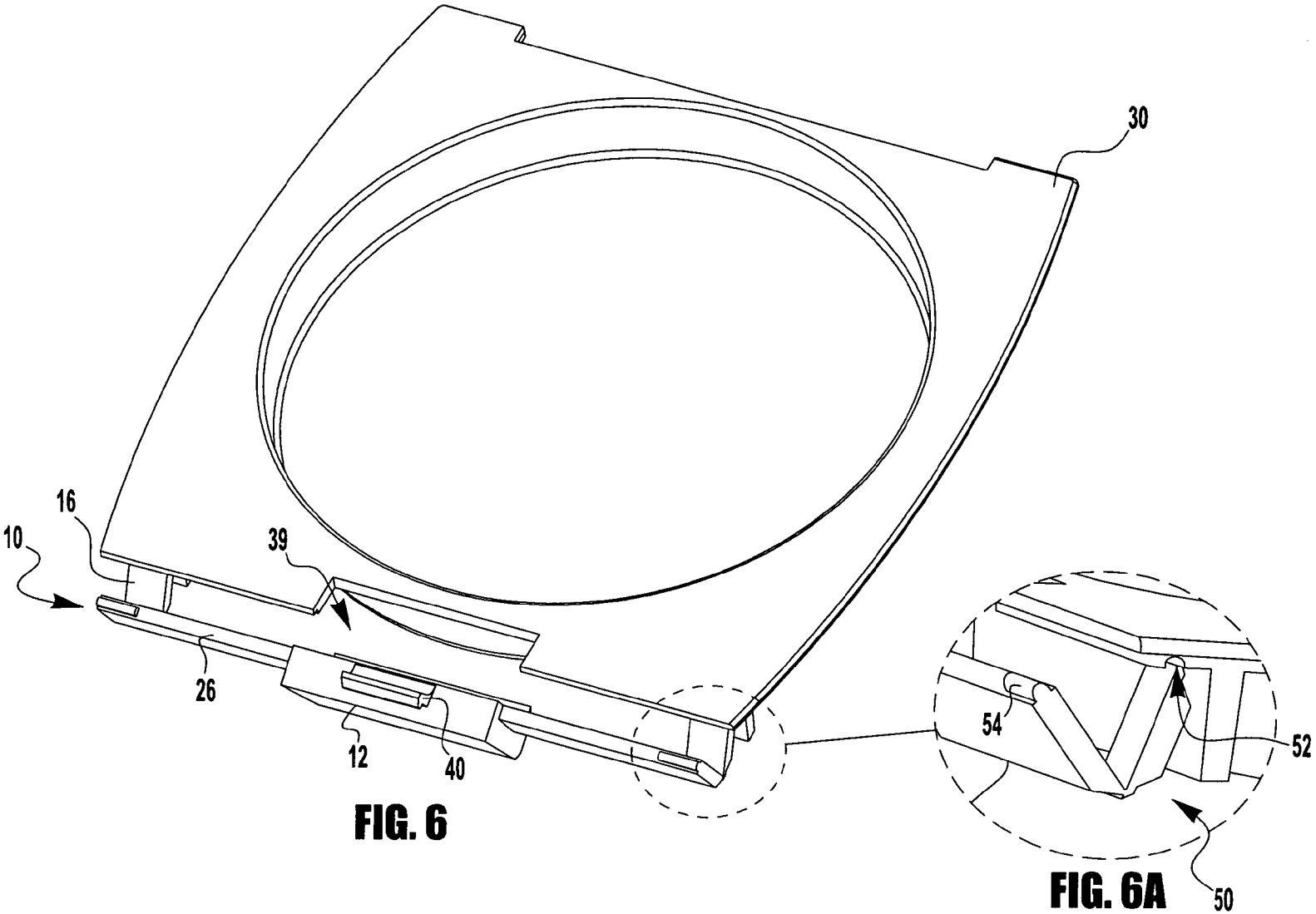
FIG. 6 is a perspective view of a package for use with a container in accordance with an exemplary embodiment, the package includes a release system that is illustrated in a position that is between a first position and a second position.
FIG. 6*a* is a detailed view of the package of FIG. 6 in accordance with an exemplary embodiment.
Figure 8:
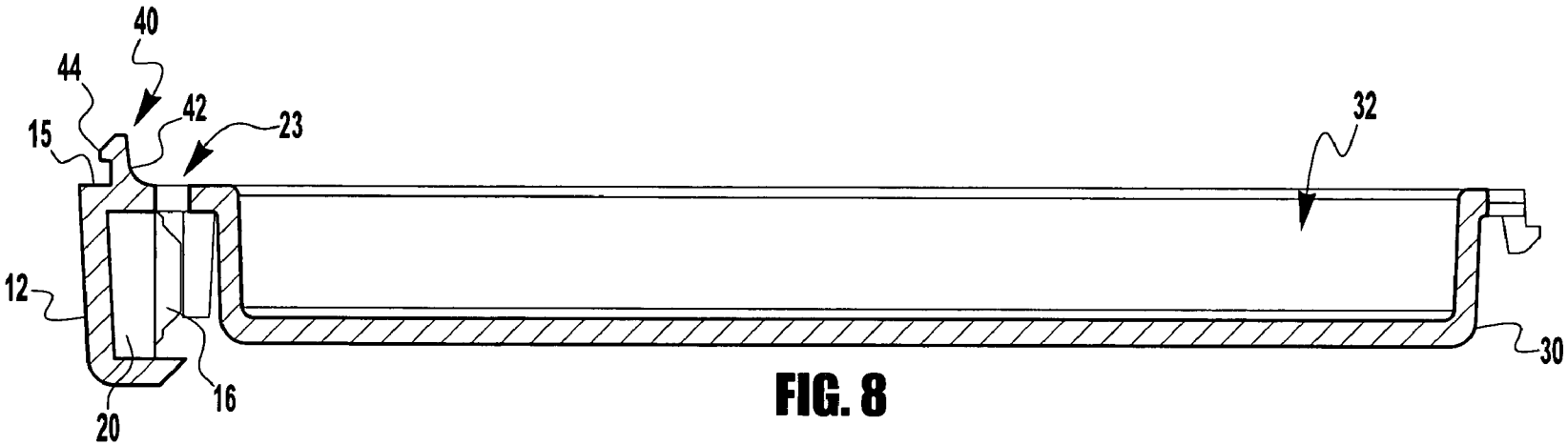
FIG. 8 is a cross sectional view of a package along line 8-8 of FIG. 7 in accordance with an exemplary embodiment.
Figure 9:
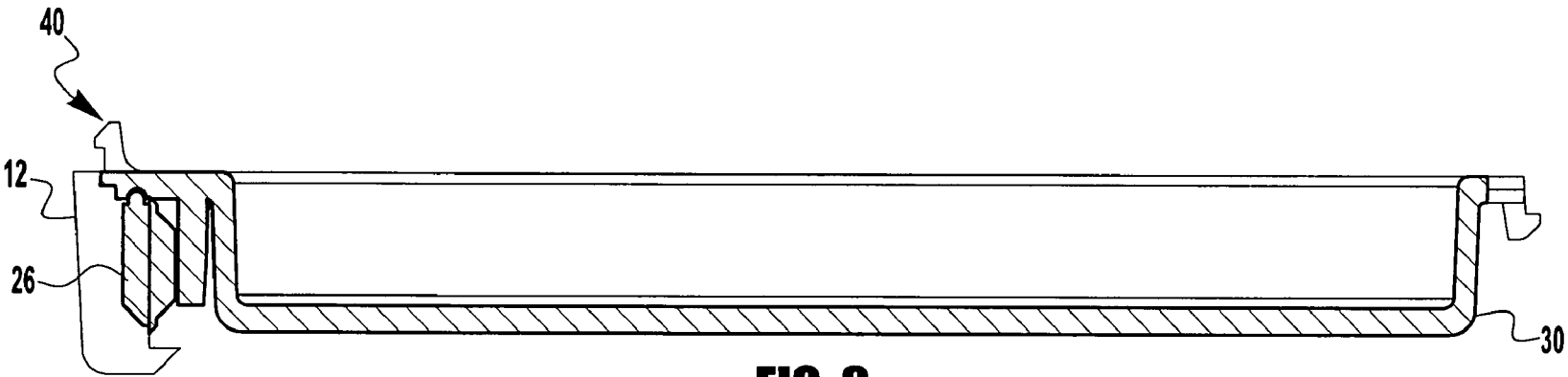
FIG. 9 is a cross sectional view of a package along line 9-9 of FIG. 7 in accordance with an exemplary embodiment.

Referring to FIG. 6, a gap 23 is provided between user interface 12 and first platform 30. Gap 23 provides room for user interface 12 to move in a linear direction when depressed by a user. According to a preferred embodiment, gap 23 is created by linking member 16 contacting a portion of first platform 30 (shown in FIG. 8). In alternative embodiments, gap 23 may be provided by a variety of structures, such as the bottom sidewall 24 contacting a portion of the first platform. User interface 12 is not limited to the push-button configuration illustrated, and may have any of a variety of configurations capable of providing actuation of the release system.

According to a preferred embodiment, release system 10 further includes a support member 26 for supporting user interface 12 in a desired position. In such a configuration, support member 26 is used to couple user interface 12 to first platform 30. Support member 26 may be pivotally coupled to linking members 16 and configured to pivot between the first position and the second position. According to a preferred embodiment, support member 26 is pivotally coupled to linking members 16 by a second pair of living hinges 18. Support member 26 may provide a biasing force that urges the release system into a locked or engaged position when coupled to a container.

To retain container 70 in the closed position (shown in FIG. 2), a locking or latching mechanism 40 is coupled to release system 10. According to a preferred embodiment, and referring to FIG. 8, latching mechanism 40 includes a projection 42 that extends upward from a top surface 15 of user interface 12. The projection 42 may include a lip 44, which can be located at the distal end of projection 42 as shown or intermediate the projection 42. In a configuration of this manner, the lip 44 is configured to releasably engage a portion of the container (e.g., an inside edge of a cover) to maintain the container in a releasably storage or closed position.

According to a preferred embodiment, lip 44 extends or bulges from the projection 42 to form an engagement surface. Lip 44 may include linear edges to form triangular, rectangular, or other polygonal shape as shown most clearly in FIG. 8. Alternatively, lip 44 may include a rounded curvilinear edge extending from projection 42, or may be configured in a variety of shapes combining both linear and nonlinear edges. According to an alternative embodiment, lip 44 may be formed by removing a portion of the projection 42 between its distal end and the top surface of the user interface 12 to which the projection 42 is coupled resulting in a lip 44 that does not bulge outward from the projection 42. In such a configuration, the container portion may include a projection that releasably engages the lip 44.

As mentioned above, release system 10 is integrally formed with a component that is to be applied to the container system 100. According to a preferred embodiment, latching mechanism 40 is also integrally formed with the release system 10 and the first platform 30. Accordingly, the user interface 12, the latching mechanism 40, the support member 26, and the linking members 16, may each be integrally formed with the first platform 30 as a single unitary body (i.e., the package). Release system 10 and first platform 30 are molded in a first position (shown in FIG. 3) which enables the details of the elements to be efficiently formed. According to a particularly preferred embodiment, the elements just mentioned are all made of the same material. For alternative mold operations, more than one material may be used, or the same material in more than one color may be used.

Figure 1:
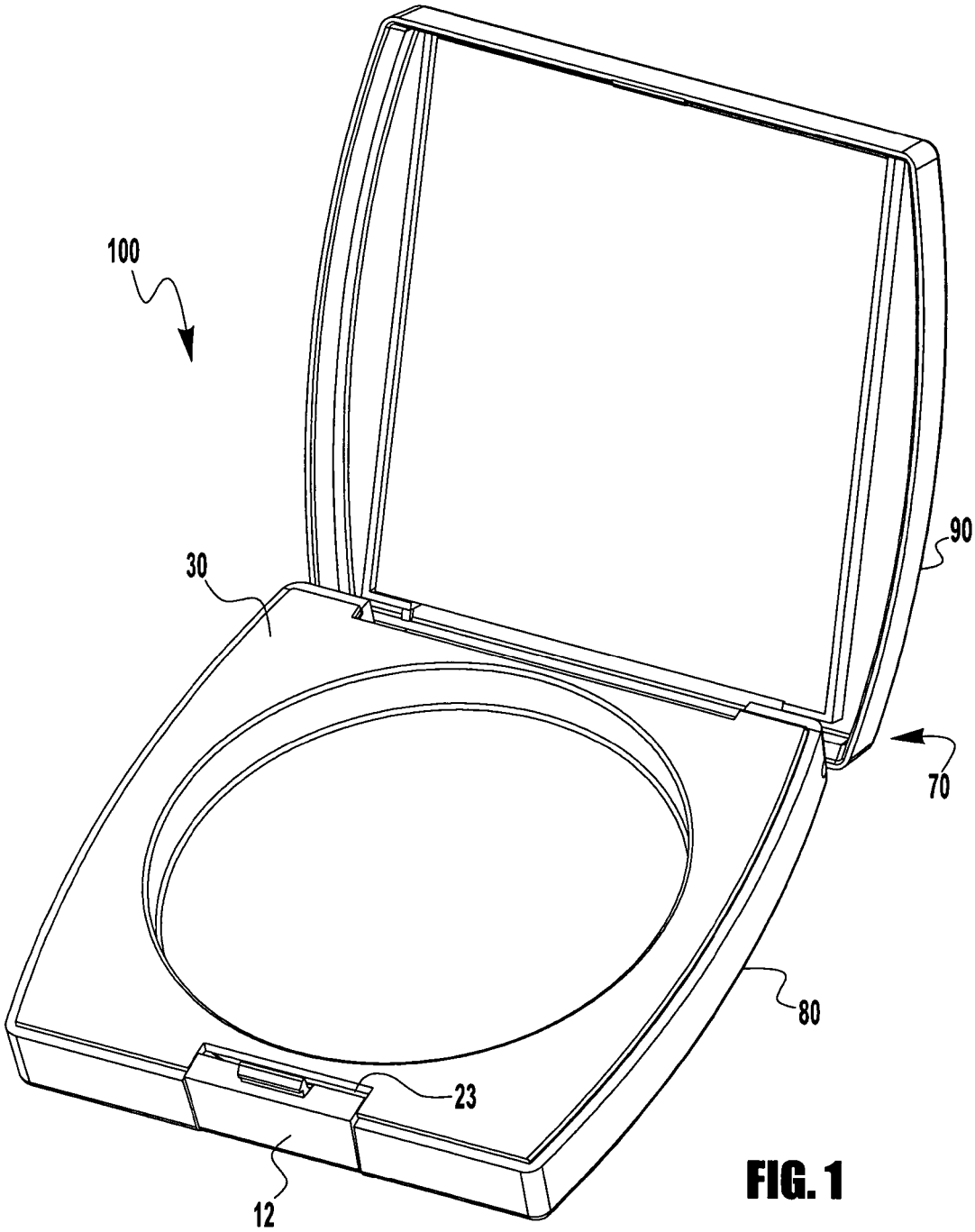
FIG. 1 is a perspective view of container system in accordance with an exemplary embodiment, the container system is shown in an open position.

Subsequent to the formation of the package, release system 10 is moved relative to first platform 30 to the second position which may advantageously hide the biasing element undesirably exposed on known container system having an integrally formed release system (shown in FIG. 1). According to a particularly preferred embodiment, release system 10 is molded in a position approximately 90 degrees from the second position. As release system 10 is moved from the first position to the second position, user interface 12 may be received by cutout portion 39 of first platform 30, and support member 26 may be positioned under front portion 34 of first platform 30. In the second position, the package may be easily applied to a container. In alternative embodiments, release system 10 may be formed in a first position that is rotated an amount other than 90 degrees from the second position.

According to an exemplary embodiment, and referring to FIGS. 6 and 6*a*, a retaining mechanism 50 may be provided that is intended to hold release system 10 in the second position while the package is being applied to a container. In a preferred embodiment, retaining mechanism 50 generally includes a recess 52 formed in front portion 34 of first platform 30 or support member 24, and a projection 54 formed in the other of the front portion or the support member. When release system 10 is moved into the second position, projection 54 engages recess 52 to hold release system 10 in such a position. According to a particularly preferred embodiment, the engagement between projection 54 and recess 52 may be characterized as a snap-fit.

Release system 10 is particularly suitable for use with container system 100 shown in the FIGURES. Container system 100 comprises the combination of a package having a release system 10 with a container 70. According to a preferred embodiment, and referring to FIG. 7, container 70 generally includes an exterior shell having a first portion (e.g., base portion, member, platform, etc.) shown as bottom portion 80, and a second platform (e.g., cover portion, member, lid, etc.) shown as top portion 90. In a closed position, as shown in FIG. 2, the container 70 surrounds an aperture configured to hold an article, such as a cosmetic substance. The aperture may be defined by bottom portion 80 or by top portion 90. Alternatively, the aperture may be partially defined by both the top portion 90 and the bottom portion 80. According to a preferred embodiment, bottom portion 80 includes an aperture 82 configured to receive a package. According to a particularly preferred embodiment, aperture 82 is configured to receive release system 10 and first platform 30. Aperture 82 may be formed by side walls 84, a front wall 86 and a back wall 88 extending upward from a base 80.

The container 70, including bottom portion 80, may be configured in a wide variety of shapes to accommodate the needs of the particular application. According to a preferred embodiment, container 70 is configured as having a generally rectangular shape. In alternative embodiments, container 70 may be configured into other well known shapes, including asymmetrical shapes.

Top portion 90 may be configured to cover the aperture 82 and enclose the retained articles when in the closed position shown in FIG. 2. Top portion 90 may be defined by a cover surface 92 and a peripheral wall 94 extending downward from cover surface 92. Preferably, peripheral wall 94 includes a groove, protrusion, chamfer or any other engaging surface along its distal end configured to releasably engage the latching mechanism 40 integral with the package. According to a particularly preferred embodiment, a rib is positioned along the distal edge of a front peripheral wall 95. As top portion 90 is moved from an open position to a closed position, the rib cams lip 44 and projection 42 of latching mechanism 40 into an engaging closed position. Top portion 90 may be disengaged from the closed position by depressing user interface 12 thereby releasing latching mechanism 40 from the rib.

Top portion 90 may be independent from bottom portion 80 or alternatively fixedly coupled relative to the bottom portion. The term "independent" as used herein is intended to describe a configuration wherein when container 70 is in an open position, the top portion 90 is not coupled to the bottom portion 80. Accordingly, the term "fixedly coupled" as used herein is intended to describe a configuration wherein when the top portion 90 is moved to the open position, the top portion is intended to remain at least partially attached to the bottom portion 80.

According to a preferred embodiment, top portion 90 is fixedly coupled to the bottom portion 80. The top portion 90 may be fixedly coupled to the bottom portion 80 by being integral with the bottom portion 80 (e.g., fixedly coupled by means of a living hinge) or attached to the bottom portion 80 through an attachment system (not shown). According to a particularly preferred embodiment, container 70 is a clamshell type container wherein top portion 90 is pivotally coupled to bottom portion 80 by the attachment system. According to a preferred embodiment, the attachment system includes a pivot shaft or rod coupled to at least one of top portion 90 and bottom portion 80, and a corresponding slot or recess formed in the other of top portion 90 and bottom portion 80. The pivot rod functions as a pivot point and is inserted into the recess thereby securing top portion 90 with bottom portion 80 while providing pivotal rotation of top portion 90 relative to bottom portion 80. As can be appreciated, the attachment system may be provided by a variety of generally known or otherwise appropriate attachment configurations including, but not limited to, a mechanical hinge.

A method of manufacturing the container system 100 according to a preferred embodiment includes the steps of forming a package comprising the first platform 30, the release system 10, and the latching mechanism 40 and applying the package to the container 70. The step of forming the package includes the step of integrally molding the user interface 12, the linking member 16, the support member 26, the latching mechanism 40, and the first platform 30 in a first position wherein the user interface 12 is at a positioned approximately 90 degrees rotated from the second position. The method further includes the step of configuring linking member 16 to be movably coupled to the first platform 30. The step of configuring linking member 16 to be movably coupled to the first platform 30 may include providing a living hinge between the linking member 16 and the first platform 30.

Figure 10:
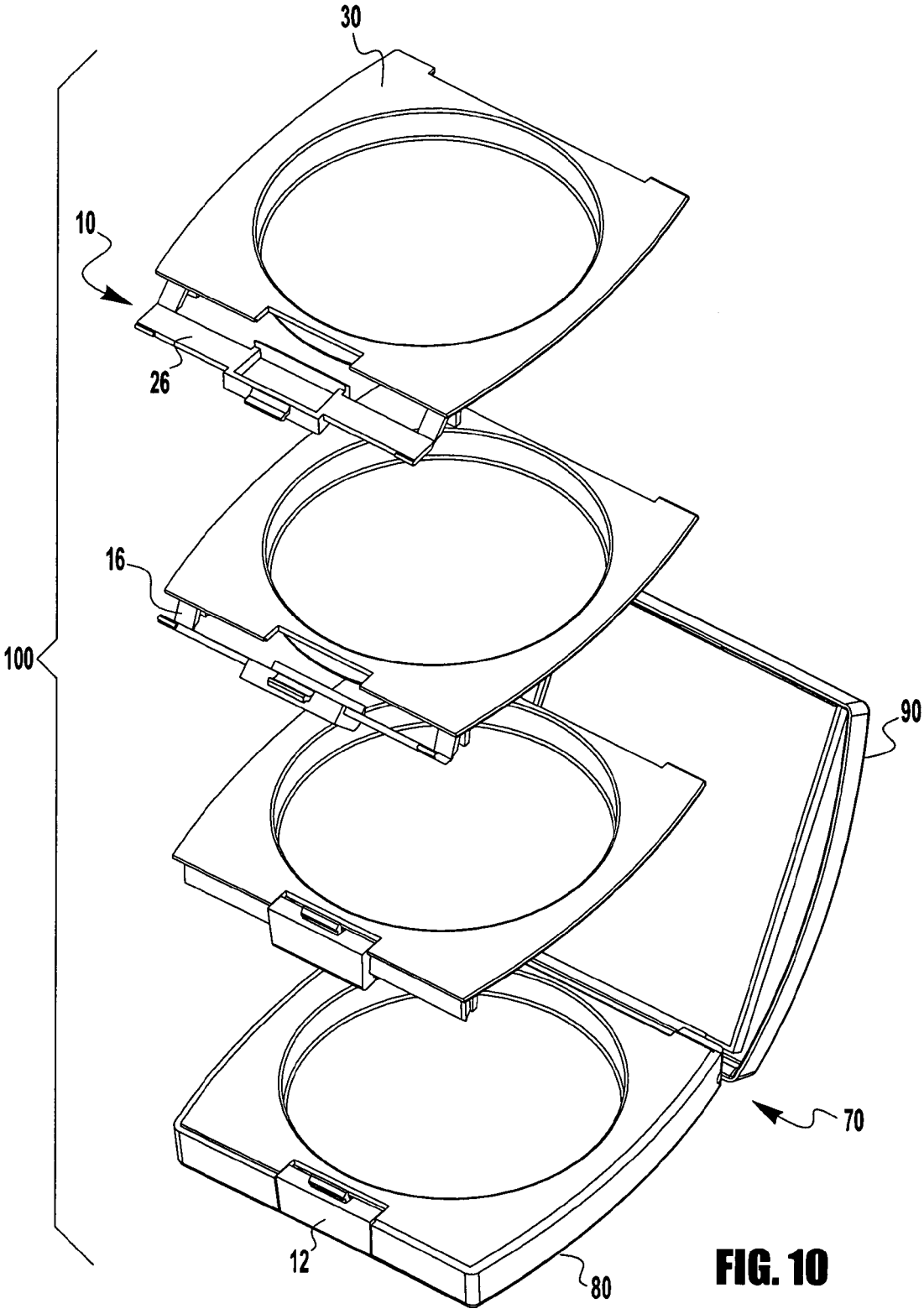
FIG. 10 is a perspective view showing a release system integrally formed with a first platform being applied to a container in accordance with an exemplary embodiment, the release system is shown as moving from a first position to a second position.

Referring to FIG. 10, the step of applying the package to the container 70 includes moving release system 10 from the first position to the second position. According to a preferred embodiment, this step involves pivotally rotating user interface 12 approximately 90 degrees so that the top surface of user interface 12 is substantially parallel with the top surface of first platform 30. Preferably, user interface 12 will be received by the cutout portion 39 of first platform 30 and support member 26 is at least partially concealed under the front portion 34 of first platform 30. According to a preferred embodiment, a retaining mechanism 50 is provided to hold release system 10 in the second position. Once user interface 12 has been moved into the second position, the first platform 30 and, the release system 10 may be easily received by the bottom portion 80 of container 70.

As can be appreciated, the assembly of the package and container 70 may be automated in such a manner that as the package is being inserted into the bottom portion 80 of the container 70, a portion of the container cams the release system 10 into the second position. Preferably, the step of applying the package to the container 70 includes inserting the package into container 70 in one motion. According to a particularly preferred embodiment, the step involves moving (e.g., dropping, placing, inserting, etc) the package in one vertical motion from a position above bottom portion 80 of container 70 into aperture 82 defined by sidewalls 84. Once first platform 30 and release system 10 are inserted, the method may include a further step of fastening the first platform 30 to the bottom portion 80. This step may include applying a snap fit between the bottom portion 80 and the first platform 30, or may include welding, frictionally engaging, applying adhesive, or applying a mechanical fastener.

It is important to note that the construction and arrangement of the elements of the container 70 and the first platform 30 having an integrally formed release system 10 as shown in the exemplary embodiment are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the release system is not limited to a push-button type release system as shown, and may be any type of release system that is formed in a first position and then rotated into a second position. Further, as mentioned above, the first platform 30 may be configured to have a plurality of cavities for holding a variety of cosmetic substances. It is readily apparent that first platform 30 may be configured to hold articles, other than cosmetic substances. For example, first platform 30 may include cavities for supporting a mirror, a cosmetic applicator (e.g., a brush, pencil, tweezers, pad, sponge, etc.), tissues, etc. The container system 100 may include a plurality of platforms or tiers, and the release system may be integrally formed with any such platform. Further, while the preferred embodiment includes a release system that is molded at a position approximately 90 degrees rotated from a use position, alternative embodiments may mold the release system at a position greater or less than 90 degrees rotated from the use position.

Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A package for use with a container, the package comprising:

a container component;

a push-button release system integrally formed with the container component, the release system comprising a user interface and a linking member, the user interface being formed in a first position and later rotated to a second position, the release system further comprising a support member coupling the user interface to the linking member, a first living hinge pivotally coupling a first end of the linking member to the container component, and a second living hinge pivotally coupling a second end of linking member to the support member, the support member biases the user interface into a locked position;

a retaining mechanism for holding the release system in the second position before the package is applied to a container, the retaining mechanism including a recess formed in one of the release system and the container component, and a projection disposed on the other of the release system and the container component that engages the recess; and a latching mechanism coupled to the release system configured to releasably engage a top portion of the container.

2. The package of claim 1, wherein the container component is a first platform having a shape corresponding to a portion of the container.

3. The package of claim 2, wherein the first platform includes an aperture for retaining an article.

4. The package of claim 3, wherein the aperture is configured to retain a cosmetic substance.

5. The package of claim 3, wherein the first platform includes a cutout portion for receiving the user interface when the release system is rotated into the second position.

6. The package of claim 2, wherein the first platform is coupled to a bottom portion of the container.

7. The package of claim 6, wherein the first platform is coupled to the bottom portion of the container by a snap fit.

8. The package of claim 6, wherein the first platform is coupled to the bottom portion of the container by ultrasonic welding.

9. The package of claim 1, wherein the container component and the release system are made of a flexible resin that enables the release system to be rotated into the second position.

10. The package of claim 9, wherein the container component and the release system are made of acrylonitrile butadiene styrene.

11. The package of claim 9, wherein the container component and the release system are made of polypropylene.

12. The package of claim 1, wherein the first position is within a range between 270 degrees and 20 degrees rotated from the second position.

13. The package of claim 12, wherein the first position is approximately 90 degrees rotated from the second position.

14. The package of claim 1, wherein the release system includes two linking members.

15. The package of claim 1, wherein the latching mechanism includes a projection extending upward from the user interface, the projection having a lip located near a distal end of the projection.

16. The package of claim 1, wherein the latching mechanism is integrally formed with the release system and the container component.

17. The package of claim 1, wherein the engagement between the projection and the recess is a snap-fit.

18. A container system for retaining a cosmetic article, the system comprising:

a container having a top portion and a bottom portion;

a package for use with the container, the package having a container component integrally formed with a release system, the release system being formed in a first position and configured to be rotated to a second position before being applied to the container, the release system comprising:

a user interface;

a linking member coupling the user interface to the container component;

a retaining mechanism for holding the release system in the second position before the package is applied to the container, the retaining mechanism including a recess formed in one of the release system and the container component and a projection disposed on the other of the release system and the container component, the projection being configured to engage the recess when the release system is moved to the second position, wherein the top portion of the container is rotatable relative to the bottom portion of the container about a hinge between an open position and a closed position; and wherein the container component is a deck supported at the bottom portion of the container, wherein the deck includes a cutout configured to receive a portion of the user interface when the release system is rotated into the second position.

19. The system of claim 18, wherein the rotational direction of the top portion of the container relative to the bottom portion of the container is substantially the same as the rotational direction of the release system between the first position and the second position.

20. The system of claim 18, wherein the user interface is molded approximately 90 degrees rotated from the second position.

21. The system of claim 18, wherein the release system is a push-button release system that is actuated by applying an inward force on the user interface.

22. The system of claim 21, further comprising a support member coupling the user interface to the linking member.

23. The system of claim 22, further comprising a latching mechanism coupled to the release system and configured to releasably engage the top portion of the container.

24. The system of claim 23, wherein the latching mechanism includes a projection extending upward from the user interface, the projection having a lip located near a distal end of the projection that is configured to engage the top portion of the container.

25. The system of claim 18, wherein the deck is received within an aperture defined by the bottom portion of the container.

26. The system of claim 18, wherein the bottom portion of the container is substantially rectangular in shape.

27. The system of claim 18, wherein the deck has a shape that substantially conforms to the shape of the bottom portion of the container.

28. The system of claim 18, wherein the deck defines a cavity configured to receive a cosmetic substance.

29. The system of claim 18, wherein the release system is positioned at a front portion of the deck.

* * * * *

UNITED STATES PATENT AND TRADEMARK OFFICE

CERTIFICATE OF CORRECTION

PATENT NO. : 7,806,290 B2
APPLICATION NO. : 10/874818
DATED : October 5, 2010
INVENTOR(S) : Allen G. Timm et al.

It is certified that error appears in the above-identified patent and that said Letters Patent is hereby corrected as shown below:

Column 1, Line 55: insert --to-- after "push-button"
Column 3, Line 21: delete "of the" after "of the"
Column 4, Line 25: replace "described" with --describe--
Column 5, Line 35: replace "FIG. 6" with --FIG. 1--

Signed and Sealed this
Seventeenth Day of April, 2012

David J. Kappos

David J. Kappos
*Director of the United States Patent and Trademark Office*